US010845174B2

(12) United States Patent
Little et al.

(10) Patent No.: US 10,845,174 B2
(45) Date of Patent: Nov. 24, 2020

(54) SHEET-METAL AMMUNITION PACKING TRAY

(71) Applicant: United States of America, Arlington, VA (US)

(72) Inventors: Gregory D. Little, Ashland, VA (US); John-Paul Shebalin, Chapel Hill, NC (US); James S. Fetsko, Fredericksburg, VA (US); Joseph A. Silber, King George, VA (US); Christopher N. Davidson, King George, VA (US); John E. Brough, Fredericksburg, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 169 days.

(21) Appl. No.: 16/157,394

(22) Filed: Oct. 11, 2018

(65) Prior Publication Data

US 2019/0041181 A1 Feb. 7, 2019

Related U.S. Application Data

(63) Continuation-in-part of application No. 15/584,276, filed on May 2, 2017, now Pat. No. 10,435,218.
(Continued)

(51) Int. Cl.

| | |
|---|---|
| ***F42B 39/26*** | (2006.01) |
| ***F42B 30/08*** | (2006.01) |
| ***F42B 39/22*** | (2006.01) |

(52) U.S. Cl.
CPC ..... *F42B 39/26* (2013.01); *F42B 30/08* (2013.01); *F42B 39/22* (2013.01)

(58) Field of Classification Search
CPC .... B65D 71/70; B65D 21/02; B65D 21/0233; B65D 71/72; F41A 9/09; F41A 9/76;
(Continued)

(56) References Cited

U.S. PATENT DOCUMENTS

2009/0026157 A1* 1/2009 Guasch ..... B65D 71/70 211/74

* cited by examiner

*Primary Examiner* — James N Smalley
*Assistant Examiner* — Madison L Poos
(74) *Attorney, Agent, or Firm* — Gerhard W. Thielman

(57) ABSTRACT

An ammunition tray is provided for containing a plurality of bullet cartridges within an ammunition box container having a stowage volume. The tray includes a substantially rectangular template having a horizontal surface bounded by first and second opposing longitudinal edges and opposing lateral edges joined at four corners. Each longitudinal edge includes a first tab bent substantially perpendicular to the surface in a vertical direction to form a rib. Each lateral edge includes a second tab bent substantially perpendicular to the surface to form a wall. The surface includes a first row of interior pockets that point towards the first longitudinal edge as a proximal orientation. The surface further includes a second row of interior pockets that point towards the second longitudinal edge as a distal orientation. The template has longitudinal and lateral edges bent to form the respective ribs and walls fits within the stowage volume as a vertical stack of plural templates. Each first interior pocket in the first row can cradle a cartridge on the surface along the proximal orientation, can fit the cartridge from an adjacent second row, and has lateral edges bent to curl in said vertical direction. Each second interior pocket in the second row can cradle the cartridge on the surface along the distal orientation, can fit the cartridge from an adjacent first row, and has lateral edges bent to curl opposite said vertical direction.

3 Claims, 4 Drawing Sheets

Related U.S. Application Data

(60) Provisional application No. 62/398,476, filed on Sep. 22, 2016.

(58) Field of Classification Search
CPC ..... F42B 39/00; F42B 39/26; F42B 30/08; F42B 39/22; F24C 15/16
USPC ..... 206/503
See application file for complete search history.

SHEET-METAL AMMUNITION PACKING TRAY

CROSS REFERENCE TO RELATED APPLICATION

The invention is a Continuation-in-Part, claims priority to and incorporates by reference in its entirety U.S. patent application Ser. No. 15/584,276 filed May 2, 2017 and assigned Navy Case 104525, which pursuant to 35 U.S.C. § 119, the benefit of priority from provisional application 62/398,476, with a filing date of Sep. 22, 2016, was claimed for that non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to ammunition packing trays. In particular, the invention provides stackable sheet metal trays for stowing bullet cartridges in an ammunition box.

Ordnance ammunition is conventionally packaged within trays composed of high density polyethylene (HDPE). Conventional HDPE cradle packaging can ignite from weapons impact, which can cause delayed cook-off reactions of damaged or undamaged rounds in the stowage container. This constitutes a serious hazard to the warfighter.

SUMMARY

Conventional ammunition dunnage trays yield disadvantages addressed by various exemplary embodiments of the present invention. In particular, exemplary embodiments provide a dunnage tray for holding ammunition cartridges within an ammunition box container having a stowage volume. The tray includes a substantially rectangular template having a horizontal surface bounded by first and second opposing longitudinal edges and opposing lateral edges joined at four corners. Each longitudinal edge includes a first tab bent substantially perpendicular to the surface to form a rib. Each lateral edge includes a second tab bent substantially perpendicular to the surface to form a wall.

In exemplary embodiments, the surface includes a first row of interior pockets that point towards the first longitudinal edge as a proximal orientation. The surface further includes a second row of interior pockets that point towards the second longitudinal edge as a distal orientation. The template has longitudinal and lateral edges bent to form the respective ribs and walls fits within the stowage volume as a vertical stack of plural templates.

Each first interior pocket in the first row can cradle a cartridge on the surface along the proximal orientation, can fit the cartridge from an adjacent second row, and include lateral edges bent in the direction of the ribs. Each second interior pocket in the second row can cradle the cartridge on the surface along the distal orientation, can fit the cartridge from an adjacent first row, and include lateral edges bent opposite the ribs. Other embodiments alternatively provide for external truncations at the corners along the first longitudinal edge.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
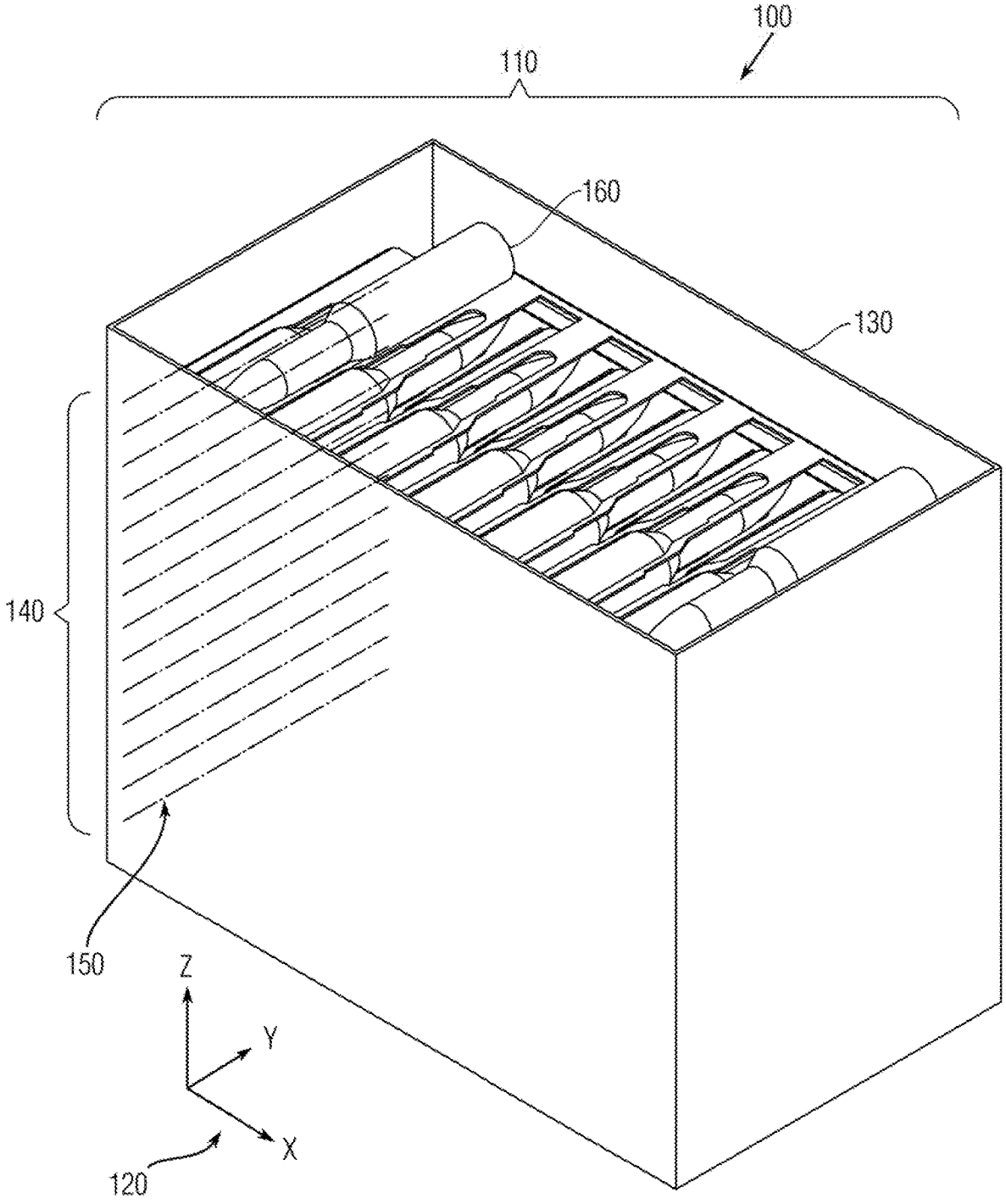
FIG. 1 is an isometric view of an ammunition box.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

One of the objectives of the exemplary embodiments presented herein includes improvement of the Insensitive Munition and safety properties of ammunition packaging. The exemplary non-flammable dunnage tray mitigates this hazardous risk.

Recent testing of 25 mm (millimeter) caliber high explosive armor piercing ordnance for Insensitive Munitions (IM) evaluation revealed susceptibility of conventional HDPE packing trays used for decades by the United States armed services to catching fire in particular IM impact scenarios. Delayed cook-off reactions of remaining cartridge rounds caused by these burning trays were observed as long as forty-two minutes after the impact that initiated the reaction. This cook-off scenario poses a serious threat to personnel safety, as the cans containing burning trays do not necessarily emit large volumes of smoke and so can appear safe to approach from a distance.

Replacement of the tray material with something non-flammable, less flammable, or containing less potential chemical energy that satisfies other packaging requirements (cost, weight, vibrational, etc.) could eliminate this hazard. In this case, packaged units of ammunition have already reached their logistical weight limit, so any solution must weigh the same as or less than the conventional HDPE packing material. For the purposes of this disclosure, a specific ammo can, the CNU-405/E packaged with unlinked 25 mm ammunition, is under examination, but the technology has broad applicability across any ammunition or ordnance packaged in trays of this type. Artisans of ordinary skill will recognize that the dimensions and stowage of unlinked ammunition described herein are exemplary and not limiting to other ordnance sizes.

Several materials were investigated that could serve as a replacement to HDPE. These included novel fire resistant or fire retardant plastics such as bishydroxydeoxybenzoin (BHDB), thermoplastics with lower potential energy such as polypropylene, reconstituted fiber-based products such as bagasse, well-characterized fire resistant meta-aramids such as Nomex™, and fireproof minerals such as vermiculite. Each of these was ultimately discarded due to such issues as insufficient Manufacturing Readiness Level, noxious off-gassing from combustion, poor workability and capacity to hold a constant shape, volumetric and weight requirements, vibrational requirements and humidity requirements. Ultimately, aluminum was selected as the candidate material with which to proceed.

FIG. 1 shows an isometric view 100 of an exemplary stowage configuration 110 with a compass rose 120 of a CNU-405/E ammunition can 130 (configured as a box container) with exemplary dunnage. The compass rose 120 depicts directions for length X, depth Y and height Z. The ammunition can 130 contains vertically arranged loading stacks 140 of exemplary trays, each level denoted by a line 150 that contains bullet cartridges 160. The ammunition can 130 for 25 mm rounds has a mass of 10 kg to 14 kg (22 lbm to 31 lbm) and has internal volume dimensions (in inches) of 17¼" long×9¾" deep×14" high.

Figure 2:
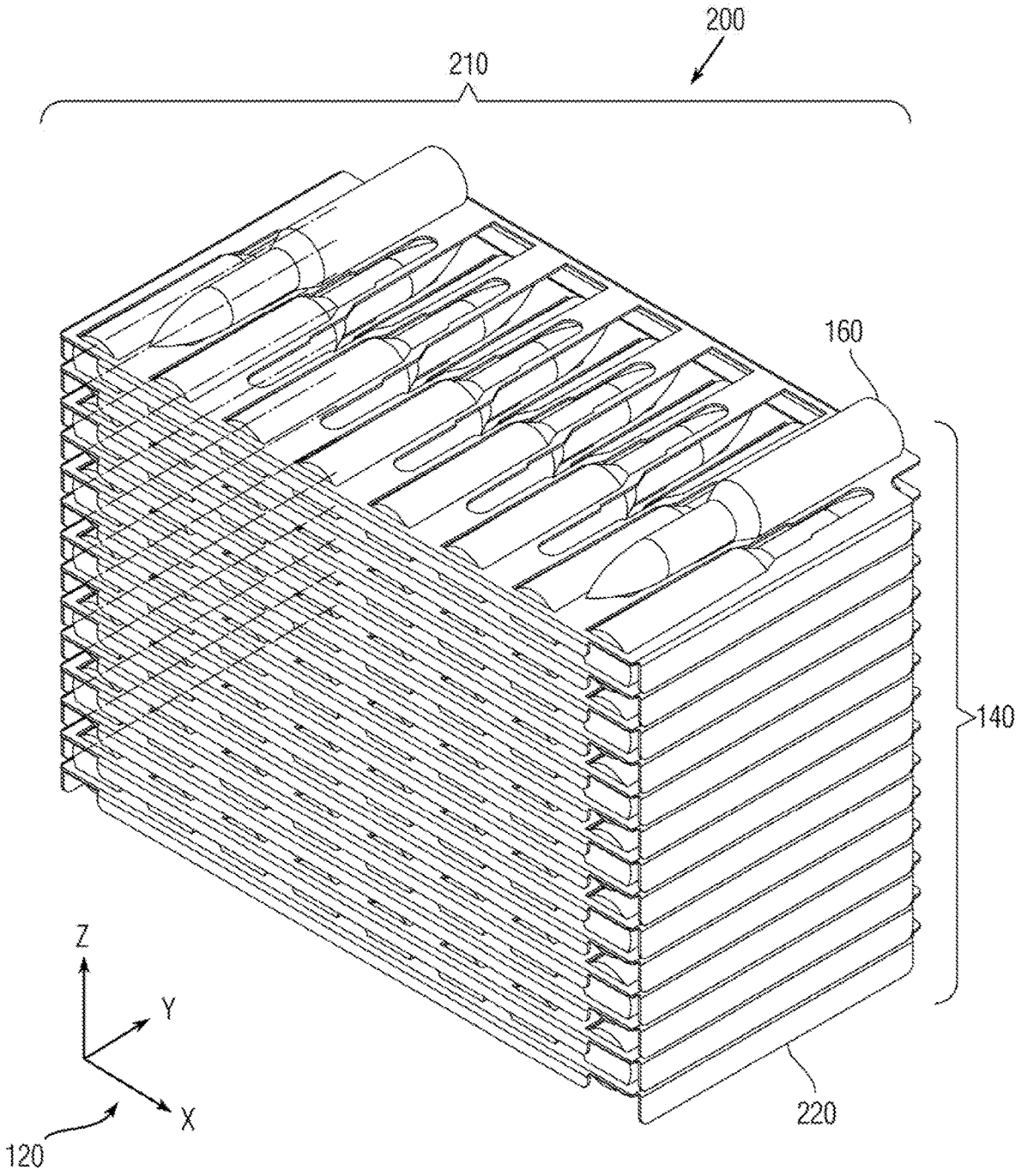
FIG. 2 is an isometric view of a dunnage stack.

FIG. 2 shows an isometric view 200 of an exemplary dunnage stack assembly 210 sans ammunition can 130 with individual dunnage trays 210 arranged in the loading stack 140 of separate exemplary trays 220 that contain the cartridges 160. The compass rose 120 depicts directions for length X, depth Y and height Z as for view 100.

Figure 3:
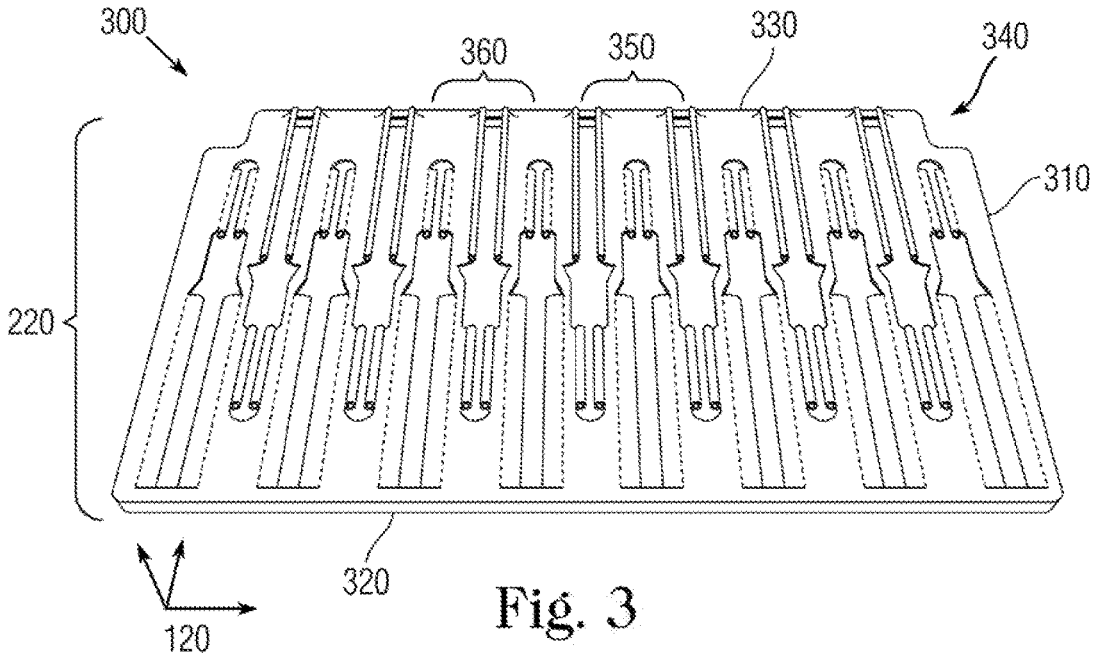
FIG. 3 is an isometric view of an exemplary ammunition tray.

FIG. 3 shows an isometric view 300 of an exemplary tray 220. Artisans will recognize that the configuration of the tray 220 described herein exhibits minor but non-trivial distinctions over the tray design in patent application Ser. No. 15/584,276. The exemplary tray 220 presents a substantially rectangular planform with folds on the side edges 310, as well as proximal and distal edges 320 and 330 for rigidity and to enable disposition atop another in the stack 140.

The tray 220 can be composed from malleable albeit rigid material provided as a thin sheet with stampings to fold edges and cut openings. Each tray 220 can be composed from a planar template, such as by rolling stock and stamping out the template sheet for subsequent bending to form the pockets. Preferably, such a template material would be inexpensive and readily available, such as aluminum or alternatively steel. For purposes of this disclosure, the sheet from which the tray 220 can be formed is described as "thin" as the longitudinal and lateral dimensions are at least one order of magnitude larger than the depth dimension that denotes thickness. An example thickness would be ~0.050 inch with the tray 220 composed preferably from 5052 aluminum, being more bendable than 6061-T6 aluminum.

The trays 220 include the corner truncations 340 at opposite corners along the distal side 330 to facilitate personnel unloading the trays 220 to grip and pull them out from the ammunition can 130. To contain the cartridges 160, the sheet 320 includes alternating interior rows of pockets oriented to the depth direction facing opposite directions. These alternating pockets point outward 350 and inward 360 (in relation to the viewer), each with a flat base and rounded fore-end. To snugly cradle the cartridges 160, the proximal edge 330 includes eight outward pockets 350, and the distal edge 330 includes seven inward pockets 360. The numbers of pockets 350 and 360 are exemplary for 25 mm ammunition with an individual tray 220 as folded for insertion into the ammunition can 130, and not limiting.

Figure 4:
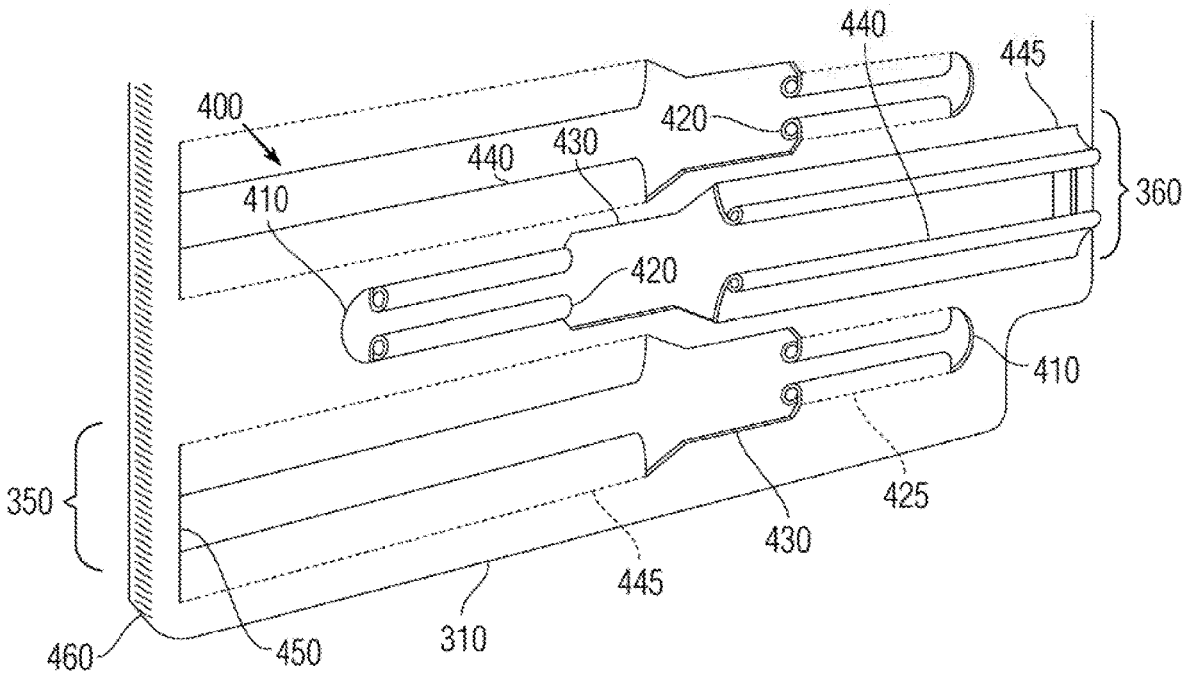
FIG. 4 is a detail view of pockets in the ammunition tray.

FIG. 4 shows an isometric view 400 of the cartridge pockets 350 and 360 of the tray 220. Both outward and inward pockets 350 and 360 include a head 410, a neck 420 with curl edge 425, a thorax 430, and an aft torso 440 with curl edge 445. The neck 420 and torso 440 on the outward pockets 350 extend downward (in relation to the Z axis) in the direction of the folded edge tabs 460. By contrast, the neck 420 and torso 440 on the inward pockets 360 extend upward, opposite the direction of the edge tabs 460. This design feature enables the tray 220 to provide cushioning separation between ammunition cartridges in an adjoining tray 220 above or below.

Figure 5:
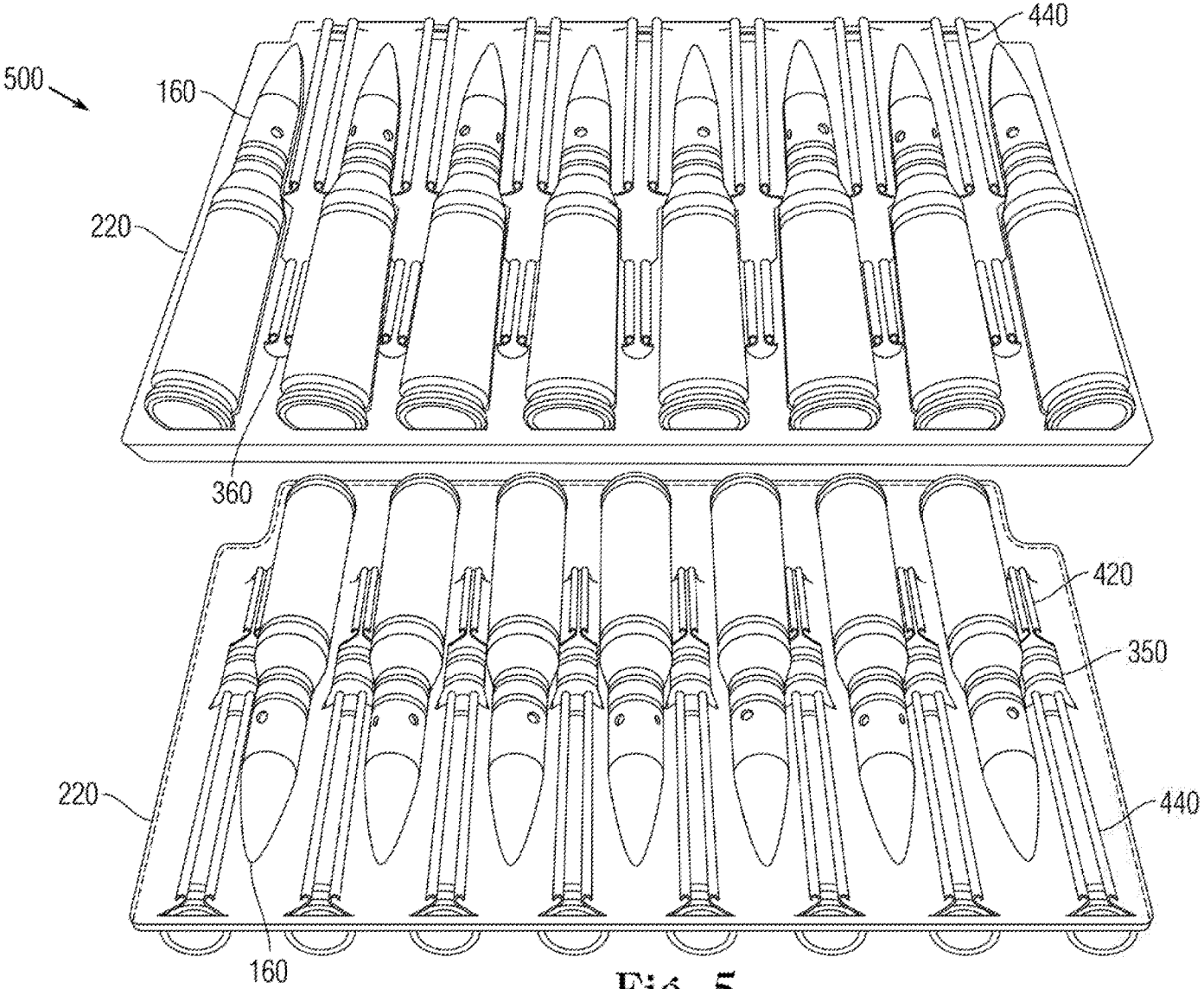
FIG. 5 is an isometric view of loaded ammunition trays.

FIG. 5 shows isometric views 500 of the trays 220 containing cartridges 160. The upper view shows a single tray 220 with the outward pockets 350 filled and the inward pockets 360 vacant. The lower view shows the pair of trays 220 with the lower tray 220 containing cartridges 160 in its outward pockets 350 and the upper tray 220 disposed above filled with additional cartridges 160 in its inward pockets 360.

The pockets 350 and 360 alternate between seven and eight cartridges 160, such as filling the lower unit with the eight outward pockets 350 and filing the upper unit with the seven inward pockets 360. A final row of two cartridges 160 in inward pockets 360 at the very top of the ammunition can 130 yields the required packing density of one-hundred rounds. The rows of pockets from adjacent trays 220 fit around the cartridges 160, both immediately below and above the 220 as filled.

In this fashion, the cartridges 160 are permitted to nest together, enabling the required packing density of one-hundred rounds per can 130 (for 25 mm rounds) while utilizing the minimum amount of aluminum (thus saving on weight and cost). Thirteen of these trays 220 stack vertically with rows of cartridges 160 alternating between eight and seven cartridges per row in between achieve the required packing density. This includes seven rows of eight cartridges 160 each for fifty-six rounds in the outward pockets 350 and six rows of seven cartridges 160 each for forty-two rounds in the inward pockets 360 plus a fourteenth tray 220 that contains two cartridges 160 at the lateral edge inward pockets 360 for the total packing count.

The trays as modified for mass-production shall consist of sheets of an appropriate ductile material (including but not limited to aluminum 5052, steel, polymers, and composites such as glass fiber reinforced polymer) in thicknesses ranging from 0.005" to 0.25" with either un-cut square blanks press formed into full-pocketed and continuous trays 220, or pre-cut blanks press-formed such that the pockets 350 and 360 are partial and slotted, saving material and permitting overpressure from any reaction of cartridges 160 to flow easily between stacked trays 220. The entire outer edge tab 460 of the tray 220 shall be swaged downward via press-forming in one undivided rim along the edges 310, 320 and 330, significantly increasing the overall rigidity of the tray 220.

The edges of both the outer flange and the pockets 350 and 360 (where pre-cut blanks are formed into slotted pockets) are further bent downward for the outward pockets 350 or else upward for the inward pockets 360 in the alternating rows, with additional press forming steps as needed to increase rigidity. A polymeric powder coating for hard-anodizing the tray 220 in addition to applying urethane in the pockets 350 and 360 produces a smoother surface where the ammunition cartridges 160 contact the trays 220 and thereby reduces wear and tear to the cartridges 160, as well as reducing the likelihood of personnel injury when bare skin of personnel comes into contact with the edges of the outer flange or slotted pockets.

While the outer flange along the tray's rim can be continuous, formation of the slotted pockets 350 and 360 enables the tabs 460 to be continuous or else incorporate stress-breaks as required by the material being utilized, so as to avoid tearing. This process to form pockets 350 and 360 necessitates that each tray 220 be flipped about its short axis with respect to its immediate neighboring trays 220 both above and below in order to ensure the pockets 350 and 360 align in such a fashion as to cradle ammunition 160 both above and below.

Although as the preferred template material aluminum is combustible, the powder form denotes its preferred ignition mode with ignition temperature of about 730° C. This is above its melting point of 600° C. and well beyond empirical observation temperatures. Replacing the HDPE cradle design with thin aluminum sheet stock can eliminate excess padding material. The exemplary sheet stock has specially shaped pockets 350 and 360 to support cartridge rounds 160 in a nested pattern of alternating rows with suitable spacing, hence reducing both weight and cost. In addition, these pockets enable internal pressure equalization between trays in the event of sympathetic reaction of a cartridge resulting from impact. This reduces the likelihood of the can's lid being blown off from the propensity of the conventional HDPE tray to behave as a sail in the wind, a potentially lethal hazard observed in testing.

The edge tabs 460, as well as the curled neck 420 and torso 440, of the aluminum tray 220 increase stiffness and enhance durability to produce a more robust and thereby reusable design. This contrasts with the conventional HDPE trays, which are routinely thrown overboard after being unpacking due to cracks and other damage received during handling. In addition, conventional HDPE trays bow substantially when fully loaded, leading to the potential of spilling rounds that the stiffness of the exemplary aluminum trays 220 can inhibit.

Prototype examples of the trays 220 used for testing purposes were cut with a water-jet, including the corner truncations 340 and the pockets 350 and 360. The finalized design would be stamped into thin sheets of aluminum. Benefits for this design extend beyond all of the United States armed services (using conventional stowage for unlinked ammunition as well as other ordnance), as allied nations employ the same conventional HDPE packaging trays in their military applications.

This is being proposed to improve munition/ordnance safety while deployed aboard ship and during transport and storage. The exemplary trays 220 do not burn as do conventional HDPE trays, thereby improving safety. Being composed of sheet aluminum and utilizing folded edges, the exemplary configuration 110 is stiffer, stronger and more reusable than the conventional tray arrangement as well at nearly the same mass. By comparison, the weights of the conventional and exemplary trays are 155 grams and 170 grams for 25 mm ammunition. Additionally, the stiffness reduces risk spilling of rounds compared to HDPE trays that bow substantially in the center when fully loaded with rounds.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An ammunition tray for containing a plurality of bullet cartridges within an ammunition box container with a stowage volume, said tray comprising:

a substantially rectangular template composed from sheet metal and having a horizontal surface bounded by first and second opposing longitudinal edges and opposing lateral edges joined at four corners;

a first tab disposed on each longitudinal edge and bent substantially perpendicular to said surface in a vertical direction to form a rib;

a second tab on each lateral edge and bent substantially perpendicular to said surface to form a wall;

a first row on said surface of first interior pockets that point towards said first longitudinal edge as a proximal orientation; and a second row on said surface of second interior pockets that point towards said second longitudinal edge as a distal orientation, wherein said longitudinal and lateral edges in said template are bent to form respective said ribs and walls to fit within the stowage volume as a vertical stack of plural templates, each first interior pocket in said first row can cradle a cartridge on said surface along said proximal orientation, can fit the cartridge from an adjacent second row, and has lateral edges bent to curl in said vertical direction, each second interior pocket in said second row can cradle the cartridge on said surface along said distal orientation, can fit the cartridge from an adjacent first row, has lateral edges bent to curl opposite said vertical direction.

2. The tray according to claim 1, wherein said template further includes external truncations at said corners along said first longitudinal edge.

3. The tray according to claim 1, wherein said template is formed from aluminum sheet metal.

* * * * *